US006102247A

United States Patent [19]

Crawford

[11] Patent Number: 6,102,247

[45] Date of Patent: Aug. 15, 2000

[54] TRIFOLD DISPENSER BLANK FOR TAPE STRIP PADS

[75] Inventor: Dennis L. Crawford, Roberts, Wis.

[73] Assignee: 3M Innovative Properties Company, St. Paul, Minn.

[21] Appl. No.: 09/126,014

[22] Filed: Jul. 29, 1998

[51] Int. Cl.[7] ..... B65H 1/00

[52] U.S. Cl. ..... 221/61; 221/33; 206/555

[58] Field of Search ..... 221/33, 34, 61, 221/63; 206/555, 37

[56] References Cited

U.S. PATENT DOCUMENTS

| | | | |
|---|---|---|---|
| D. 306,462 | 3/1990 | Miles et al. | D19/69 |
| D. 348,484 | 7/1994 | Blackwell et al. | D19/69 |
| D. 348,690 | 7/1994 | Samuelson | D19/69 |
| D. 359,513 | 6/1995 | Carlson | D19/86 |
| D. 387,806 | 12/1997 | Carlson et al. | D19/86 |
| 4,416,392 | 11/1983 | Smith | 221/45 |
| 4,562,938 | 1/1986 | Loder | 221/46 |
| 4,586,629 | 5/1986 | Loder | 221/46 |
| 4,586,631 | 5/1986 | Loder | 221/58 |
| 4,650,706 | 3/1987 | Emmel | 428/40 |
| 4,653,666 | 3/1987 | Mertens | 221/45 |
| 4,742,913 | 5/1988 | Emmel et al. | 206/460 |
| 4,770,320 | 9/1988 | Miles et al. | 221/33 |
| 4,781,306 | 11/1988 | Smith | 221/33 |
| 4,907,825 | 3/1990 | Miles et al. | 281/51 |
| 4,986,440 | 1/1991 | Windorski | 221/45 |
| 4,993,590 | 2/1991 | Windorski | 221/46 |
| 5,050,909 | 9/1991 | Mertens et al. | 283/81 |
| 5,080,255 | 1/1992 | Windorski | 221/45 |
| 5,086,946 | 2/1992 | Blackwell et al. | 221/45 |
| 5,158,205 | 10/1992 | Bodziak et al. | 221/51 |
| 5,167,346 | 12/1992 | Bodziak | 221/63 |
| 5,299,712 | 4/1994 | Carlson et al. | 221/45 |
| 5,358,141 | 10/1994 | Carlson et al. | 221/185 |
| 5,397,117 | 3/1995 | Mertens | 221/34 |
| 5,401,547 | 3/1995 | Blackwell et al. | 428/40 |
| 5,411,168 | 5/1995 | Mertens et al. | 221/22 |
| 5,518,144 | 5/1996 | Samuelson et al. | 221/33 |
| 5,526,955 | 6/1996 | Windorski et al. | 221/34 |
| 5,607,737 | 3/1997 | Blackwell et al. | 428/40.1 |
| 5,671,866 | 9/1997 | Bodziak | 221/45 |
| 5,755,356 | 5/1998 | Bastiaens et al. | 221/33 |
| 5,769,270 | 6/1998 | Fujisawa et al. | 221/34 |

FOREIGN PATENT DOCUMENTS

| | | | |
|---|---|---|---|
| 2203359 | 5/1974 | France . | |
| 2365998 | 4/1978 | France . | |
| 2123469 | 11/1972 | Germany . | |
| WO 97/48561 | 12/1997 | WIPO | B42D 5/00 |

OTHER PUBLICATIONS

3M Promotional Products 1998, p. 30–31.

PCT International Search Report dated Apr. 26, 1999.

*Primary Examiner*—H. Grant Skaggs

*Attorney, Agent, or Firm*—Michaele A. Hakamaki

[57] ABSTRACT

A single-piece dispenser blank of integrally formed construction with (i) a central section having a circumferential wall projecting from the first major surface and defining an open well, (ii) a first section pivotably connected to the central section and having a concave first surface, an access opening, and projections extending from the second surface proximate opposite ends of the opening, (iii) a means for repeatedly permitting nondestructive attachment and detachment of the first section to the central section, with the first surface of the first section in overlapping engagement with the first surface of the central section, (iv) a second section pivotably connected to the central section and having a concave first surface, and (v) a means for repeatedly permitting nondestructive attachment and detachment of the second section to the first section, with the first surface of the second section in overlapping engagement with the second surface of the first section.

13 Claims, 2 Drawing Sheets

TRIFOLD DISPENSER BLANK FOR TAPE STRIP PADS

FIELD OF THE INVENTION

The invention relates to dispensers for tape strip pads.

BACKGROUND OF THE INVENTION

Numerous types of pressure sensitive adhesive tapes capable of connecting or joining two surfaces (e.g., adhering a sheet of paper onto a table top) are well known. For example, transparent tape of the type available from Minnesota Mining and Manufacturing Company of St. Paul, Minn. under the trade designation Magic® brand is readily available from numerous retail outlets. Such pressure sensitive adhesive tapes, are generally available as a continuous roll of tape capable of being conveniently dispensed from any of a number of manually-operated roll-type tape dispensers, such as those disclosed in Walker et al., U.S. Pat. No. 4,928,864 and Reinecke, U.S. Design Pat. No. 116,599, having a cutting edge located on the dispenser for cutting the tape into strips of the desired length. While effective for quickly and efficiently dispensing most pressure sensitive adhesive tapes, it is difficult to create tape strips of uniform length due to the natural variations in the length of tape unwound from the roll of adhesive tape between cuttings. Hence, such dispensers are not designed for those situations requiring the quick and efficient dispensing of uniform lengths of pressure sensitive adhesive tape.

It is also known to dispense pressure sensitive adhesive tape from a stacked pad of tape strips. Such pads of adhesive tape strips are disclosed in Emmel, U.S. Pat. No. 4,650,706, and Mertens, U.S. Pat. No. 4,895,746. Emmel discloses a stacked pad of adhesive tape strips wherein a first end portion of each individual strip is treated so as to provide a nonadhesive end tab. Mertens discloses a stacked pad of adhesive tape strips wherein a first end portion of each individual strip defines an area of reduced adhesion to an adjacent tape strip. The nonadhesive end tab or area of reduced adhesion facilitates initial separation of the first end of an uppermost tape strip from the first end of an immediately underlying tape strip, allowing the uppermost tape strip to be peeled off the pad. While generally effective for dispensing uniform lengths of pressure sensitive adhesive tape, such pads are somewhat cumbersome to use in those situations where only one hand is available for dispensing the tape, such as gift wrapping.

A significant advance in the construction and dispensing of pads of adhesive tape strips is disclosed in the Blackwell et al. patents, U.S. Pat. Nos. 5,401,547 and 5,607,737. The Blackwell et al. patents disclose a pad of superimposed adhesive tape strips wherein the adhesive layer of each tape strip is releasably adhered to an adjacent tape strip at a first adhesion level at a first end and a second adhesion level at a second end (i.e., differential release), and sequential tape strips are longitudinally reversed so as to align the first end of each tape strip with the second end of an immediately overlaying and an immediately underlying tape strip. Such an alternately stacked pad of differential release tape strips can be conveniently dispensed from an associated dispenser with a single hand while maintaining a continuous coating of a pressure sensitive adhesive on the substrate.

A variety of dispensers have been developed for dispensing individual tape strips from such pads of adhesive tape strips. Exemplary dispensers are disclosed in U.S. Pat. Nos. 5,086,946; 5,518,144; 5,299,712; 5,358,141; 5,755,356; 348,690; 348,484; 359,513; 387,806 and PCT Publication WO 97/48561. Such dispensers include (i) disposable and refillable dispensers, (ii) high volume/high profile and low volume/low profile dispensers, and (iii) hand held and mountable dispensers.

While the various dispensers available for pads of adhesive tape strips provide certain benefits for certain applications, a need continues to exist for an inexpensive, closeable and portable dispenser capable of being quickly and easily refilled, and capable of holding a high volume of tape strips while maintaining a modest profile consistent with portability.

SUMMARY OF THE INVENTION

A single-piece dispenser blank of integrally formed construction includes (i) a central section having a circumferential wall projecting from the first major surface and defining an open well, (ii) a first section pivotably connected to the central section and having a first surface defining a cavity, a centrally positioned opening, and projections extending from the second surface proximate opposite ends of the opening, (iii) a means for repeatedly permitting nondestructive attachment and detachment of the first section to the central section, with the first surface of the first section in overlapping engagement with the first surface of the central section, (iv) a second section pivotably connected to the central section and having a first surface defining a cavity, and (v) a means for repeatedly permitting nondestructive attachment and detachment of the second section to the first section, with the first surface of the second section in overlapping engagement with the second surface of the first section.

The sections are configured and arranged relative to one another so that (a) the first surface of the central section and the first surface of the first section cooperatively form a retention chamber for a tape strip pad when the first surface of the first section is pivoted into overlapping engagement with the first surface of the central section, and (b) the second section covers the opening in the first section when the first surface of the first section is pivoted into overlapping engagement with the first surface of the central section, and the first surface of the second section is pivoted into overlapping engagement with the second surface of the first section.

DETAILED DESCRIPTION OF THE INVENTION INCLUDING A BEST MODE

Definitions

Figure 1:
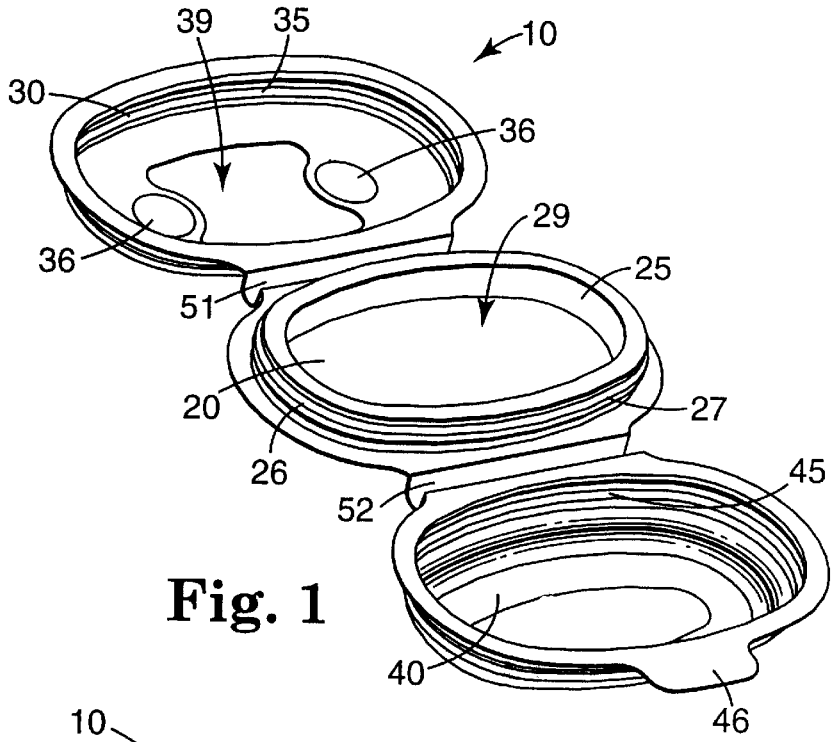
FIG. 1 is a perspective view of one embodiment of the dispenser blank.

As utilized herein, including the claims, the term "releasably secure" means to attach in such a manner that the attached items may be repeatedly attached and detached without the aid of tools in a nondestructive manner. Examples of releasable securing devices include specifically, but not exclusively, buttons, friction fittings, locking rings, snaps, threads, and hook and loop fasteners.

NOMENCLATURE

| | |
|---|---|
| x | Longitudinal Axis of Dispenser Blank |
| y | Latitudinal Axis of Dispenser Blank |
| 10 | Dispenser Blank |
| 10' | Assembled Dispenser |
| 11 | First Major Surface |
| 12 | Second Major Surface |
| 20 | Central Section of Blank |
| 21 | First Major Surface of Central Section |
| 22 | Second Major Surface of Central Section |
| 23 | First Side of Central Section |
| 24 | Second Side of Central Section |
| 25 | Circumferential Wall |
| 26 | Outer Surface of Circumferential Wall |
| 27 | Circumferential Bump Projecting Outward from Outer Surface of Circumferential Wall |
| 29 | Open Well |
| 30 | First Section |
| 31 | First Major Surface of First Section |
| 32 | Second Major Surface of First Section |
| 33 | First Side of First Section |
| 34 | Second Side of First Section |
| 35 | Circumferential Flange Projecting Inward from First Major Surface of First Section |
| 36 | Projections |
| 37 | Peripheral Bump Projecting Outward from Second Major Surface of First Section |
| 39 | Access Opening |
| 39a | First Longitudinal End of Opening |
| 39b | Second Longitudinal End of Opening |
| 40 | Second Section |
| 41 | First Major Surface of Second Section |
| 42 | Second Major Surface of Second Section |
| 43 | First Side of Second Section |
| 44 | Second Side of Second Section |
| 45 | Peripheral Flange Projecting Inward from First Major Surface of Second Section |
| 46 | Tab |
| 51 | Living Hinge Connecting First Section to Central Section |
| 52 | Living Hinge Connecting Second Section to Central Section |
| 60 | Retention Chamber |
| 100 | Tape Strip Pad |

Construction

Referring to FIGS. 1–6, one embodiment of the present invention comprises a tape dispenser blank 10 having first 11 and second 12 major surfaces divided into three separately identifiable sections, with a central section 20 of the tape dispenser blank 10 connected to a first section 30 by a first living hinge 51 and connected to a second section 40 by a second living hinge 52.

The sections are configured and arranged relative to one another so that (i) a first major surface 21 of the central section 20 and a first major surface 31 of the first section 30 cooperatively form a retention chamber 60 (shown in FIG. 6) when the first major surface 31 of the first section 30 is pivoted about the first living hinge 51 into overlapping engagement with the first major surface 21 of the central section 20, and (ii) the second section 40 protectively covers the first section 30 when (A) the first major surface 31 of the first section 30 is pivoted about the first living hinge 51 into overlapping engagement with the first major surface 21 of the central section 20, and (B) a first major surface 41 of the second section 40 is pivoted about the second living hinge 52 into overlapping engagement with a second surface 32 of the first section 30.

Center Section

The first major surface 21 of the central section 20 is configured and arranged to permit a tape strip pad 100 of the type disclosed in U.S. Pat. Nos. 5,086,946; 5,401,547 and 5,607,737 and available from Minnesota Mining and Manufacturing Company (known as pop-up tape strip pads), to be securely attached to the first major surface 21 of the central section 20, such as by an aggressive pressure sensitive adhesive or double-coated pressure sensitive adhesive tape.

Figure 2:
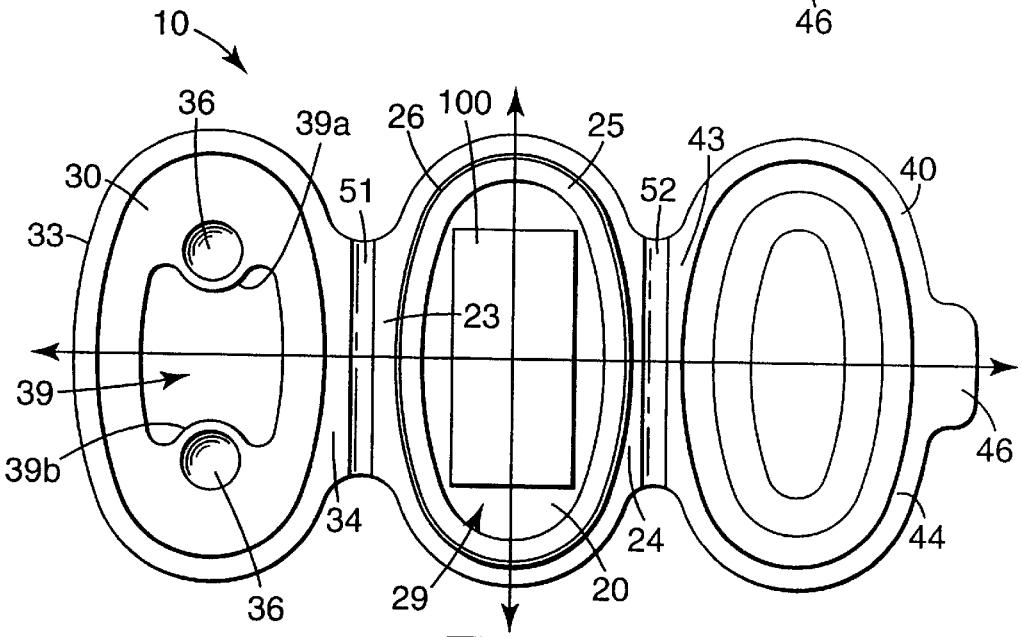
FIG. 2 is a top view of the dispenser blank of FIG. 1.
Figure 3:
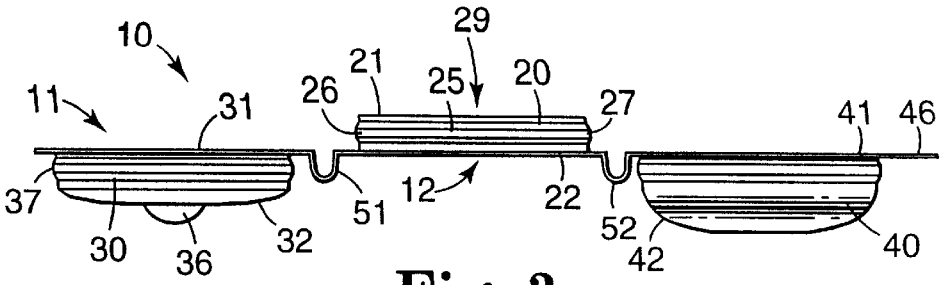
FIG. 3 is an end view of the dispenser blank of FIG. 1.

As shown in FIGS. 1–3, a preferred configuration of the first major surface 21 of the central section 20 provides a circumferential wall 25 defining an open well 29 capable of accommodating a tape strip pad 100. Alternatively, the first major surface 21 of the central section 20 could be configured with a raised platform (not shown) for accommodating a tape strip pad 100.

First Section

The first section 30 includes a access opening 39 and is connected to the first side 23 of the central section 20 by a first living hinge 51. The first section 30 can alternatively be connected to the central section 20 along one of the other sides (unnumbered) of the central section 20 so long as the necessary configurational relationship between the three sections 20, 30 and 40 is maintained. The first major surface 31 of the first section 30 defines a cavity (e.g., a concavity) capable of forming a retention chamber 60 in cooperation with the first surface 21 of the central section 20 when the first major surface 31 of the first section 30 is pivoted about the first living hinge 51 into overlapping engagement with the first major surface 21 of the central section 20. The resultant retention chamber 60 is effective for accommodating a tape strip pad 100 for dispensing of individual tape strips (unnumbered) from the tape strip pad 100 through the access opening 39 in the first section 30.

A projection 36 extends from the second major surface 32 of the first section 30 proximate each of the first 39*a* and second 39*b* longitudinal ends of the opening 39 for supporting the free end (not shown) of an uppermost tape strip (not shown) when it extends through the opening 39 above the second major surface 32 of the first section 30. Such projections 36 reduce the likelihood that the entire surface area of the free end of an uppermost tape strip, extending through the opening 39, will contact and adhere to the second major surface 32 of the first section 30 and thereby complicate dispensing of the uppermost tape strip.

A convenient means for releasably securing the first section 30 to the central section 20 with the first major surface 31 of the first section 30 facing the first major surface 21 of the central section 20 is shown in FIGS. 1 and 3. A circumferential bump 27 extends outward from the outer surface 26 of the circumferential wall 25 on the central section 20. A corresponding circumferential flange 35 projects inward from the first major surface 31 of the first section 30. The first section 30 is releasably secured to the central section 20 when the circumferential flange 35 on the first section 30 is forced past the circumferential bump 27 on the circumferential wall 25 on the central section 20. This can be accomplished by simply overlapping the sections, with the first major surface 31 of the first section 30 facing the first major surface 21 of the central section 20, and squeezing the sections together until they "snap" into place.

Other means, known in the art, may be employed for releasably securing the the first section 30 to the central section 20, ranging from friction fitting of the two sections to hook and loop tape.

Second Section

Figure 4:
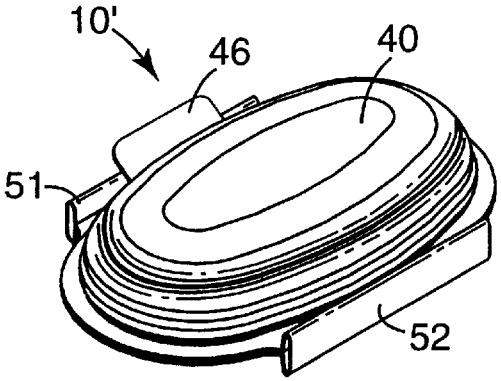
FIG. 4 is a perspective view of the dispenser blank of FIG. 1 assembled into a dispenser.
Figure 5:
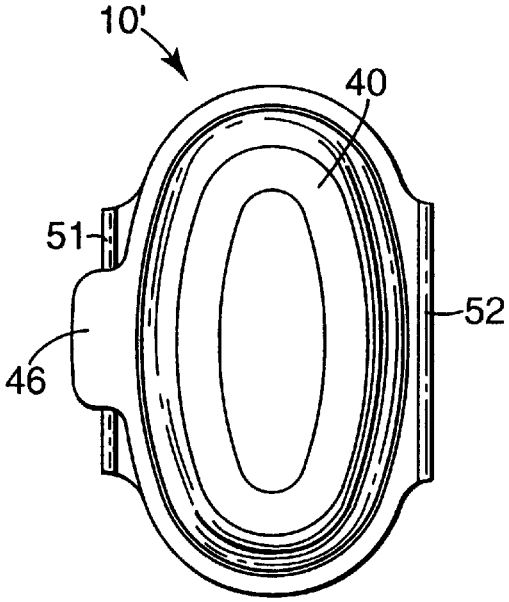
FIG. 5 is a top view of the dispenser of FIG. 4.
Figure 6:
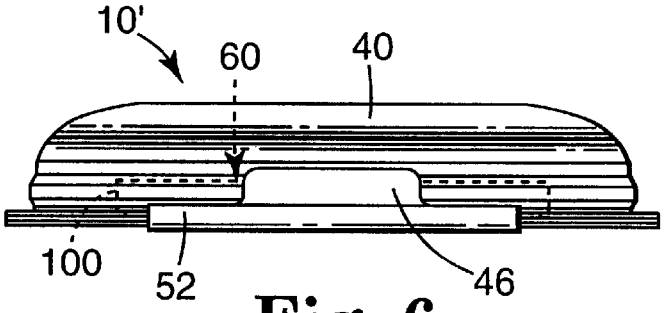
FIG. 6 is a side view of the dispenser of FIG. 4.

The second section 40 is connected to the second side 24 of the central section 20 by a second living hinge 52. The second section 40 could alternatively be connected to the central section 20 along one of the other sides (unnumbered) so long as the first 30 and second 40 sections can be independently pivoted into overlapping relationship with the central section 20. The first major surface 41 of the second section 40 defines a cavity (e.g., a concavity) for purposes of accommodating the first section 30 underneath the second section 40 when the first major surface 41 of the second section 40 is pivoted about the second living hinge 52 into overlapping engagement with the second major surface 32 of the first section 30. The second section 40 is effective for covering the opening 39 in the first section 30 when the second section 40 overlaps the first section 30, thereby rendering the dispenser 10' portable as shown in FIGS. 4–6.

A convenient means for releasably securing the second section 40 to the first section 30 with the first major surface 41 of the second section 40 facing the second major surface 32 of the first section 30 is shown in FIGS. 1 and 3. A peripheral bump 37 extends outward from the second major surface 32 of the first section 30. A corresponding peripheral flange 45 projects inward from the first major surface 41 of the second section 40. The second section 40 is releasably secured to the first section 30 when the first section 30 is secured to the central section 20 and the peripheral flange 45 on the second section 40 is forced past the peripheral bump 37 on the first section 30. This can be accomplished by simply overlapping the sections, with the first major surface 41 of the second section 40 facing the second major surface 32 of the first section 30, and squeezing the sections together until they "snap" into place.

Other means, known in the art, may be employed for releasably securing the the first section 30 to the central section 20, ranging from friction fitting of the two sections to hook and loop tape.

A tab 46 is preferrably provided opposite the second living hinge 52 for facilitating opening of the dispenser 10'.

Table One provides a summary of acceptable and preferred dimensions for the various elements of one embodiment of the dispenser blank 10 effective for accommodating and dispensing commonly available tape strip pads 100.

TABLE ONE

DIMENSIONS OF DISPENSER BLANK

| ELEMENT DIMENSION | ACCEPTABLE (CM) | PREFERRED (CM) |
|---|---|---|
| Central Section Longitudinal Length | 7–10 | 7–8 |
| Central Section Lateral Width | 3–5 | 3–4 |
| Open Well Depth | 0.2–2 | 0.5–1 |
| First Section Longitudinal Length | 7–10 | 7–8 |
| First Section Lateral Width | 3–5 | 3–4 |
| First Section Depth | 0.5–2 | 0.8–1.5 |
| Opening Longitudinal Length | 2–5 | 2–3 |
| Opening Lateral Width | 1–3 | 2–3 |
| Projection Depth | 0.2–0.5 | 0.2–0.5 |
| Second Section Longitudinal Length | 7–10 | 7–8 |
| Second Section Lateral Width | 3–5 | 3–4 |
| Second Section Depth | 0.5–2 | 0.8–1.5 |
| Retention Chamber Longitudinal Length | 5–10 | 7–8 |
| Retention Chamber Lateral Width | 2–5 | 3–4 |
| Retention Chamber Depth | 1–2 | 1–2 |

Method of Manufacture

The dispenser blank 10 may be constructed from a number of different suitable materials including specifically, but not exclusively card stock and thermoplastic sheet materials such as polyethylene, polypropylene and polyethylene terephthalate. The dispenser blank 10 may be quickly and inexpensively thermoformed from a sheet of recyclable thermoplastic material having a generally uniform thickness of between about 10 to 30 mils.

Process of Using

The dispenser blank 10 may be quickly assembled into a portable dispenser 10' by sequentially (i) adhering or otherwise attaching a tape strip pad 100 to the first major surface 21 of the central section 20 as shown in FIG. 2, (ii) pivoting the first section 30 about the first living hinge 51 into overlapping engagement with the central section 20 with first major surface 31 of the first section 30 facing the first major surface 21 of the central section 20, (iii) snapping the first section 30 and central section 20 together, (iv) pivoting the second section 40 about the second living hinge 52 into overlapping engagement with the first section 30 with the first major surface 41 of the second section 40 facing the second major surface 32 of the first section 30, and (v) snapping the first section 30 and second section 40 together.

A tape strip may be dispensed from the dispenser 10' by sequentially (i) gripping the tab 46 while holding onto the edges of the central 20 and/or first 30 sections and detaching the second section 40 from the first section 30, (ii) pivoting the second section 40 about the second living hinge 52 away from the first section 30 so as to expose the opening 39 in the first section 30, (iii) pulling on the free end of the uppermost tape strip extending through the opening 39 until the uppermost tape strip is completely detached from the underlying tape strip, (iv) permitting the free end of the underlying tape strip (now the uppermost tape strip) extending through the opening 39 to fall back into contact with a projection 36, (v) repeating steps (iii) and (iv) as necessary to dispense the desired number of individual tape strips, (vi) pivoting the second section 40 about the second living hinge 52 back into overlapping engagement with the first section 30 with the first major surface 41 of the second section 40 facing the second major surface 32 of the first section 30, and (vii) snapping the first section 30 and second section 40 together to close the dispenser 10'.

What is claimed is:

1. A single-piece dispenser blank of integrally formed construction having opposed first and second surfaces, comprising:

(a) a central section having a circumferential wall projecting from the first surface and defining an open well, (b) a first section pivotably connected to the central section and having (A) a first surface defining a cavity, (B) a second surface, (C) an access opening, and (D) projections extending from the second surface proximate opposite ends of the opening, (c) a means for repeatedly permitting nondestructive attachment and detachment of the first section to the central section, with the first surface of the first section in overlapping engagement with the first surface of the central section, (d) a second section pivotably connected to the central section and having a first surface defining a cavity, (e) a means for repeatedly permitting nondestructive attachment and detachment of the second section to the first section, with the first surface of the second section in overlapping engagement with the second surface of the first section, (f) wherein the sections are configured and arranged relative to one another such that (i) the first surface of the central section and the first surface of the first section cooperatively form a retention chamber when the first surface of the first section is pivoted into overlapping engagement with the first surface of the central section, and (ii) the second section covers the opening in the first section when (A) the first surface of the first section is pivoted into overlapping engagement with the first surface of the central section, and (B) the first surface of the second section is pivoted into overlapping engagement with the second surface of the first section.

2. The dispenser blank of claim 1, further comprising a tab extending from a side of the second section in diametric opposition to that portion of the second section pivotably attached to the central section.

3. The dispenser blank of claim 1, wherein the dispenser blank is constructed from a single sheet of thermoplastic sheet material.

4. The dispenser blank of claim 1, wherein (i) the central section has a first longitudinal end, a second longitudinal end, a first lateral side and a second lateral side, (ii) the first section is pivotably attached to the first lateral side of the central section, and (iii) the second section is pivotably attached to the second lateral side of the central section.

5. The dispenser blank of claim 4, further comprising longitudinally aligned projections extending from the second surface of the first section proximate opposite ends of the opening.

6. The dispenser blank of claim 1, wherein the second section is configured and arranged to cover substantially the entire second surface area of the first section.

7. A single-piece dispenser blank of integrally formed construction having opposed first and second surfaces, comprising:

(a) a central section having a circumferential wall projecting from the first surface and defining an open well, (b) a first section pivotably connected to the central section and having (A) a first surface defining a cavity, (B) a second surface, and (C) an access opening, (c) a means for repeatedly permitting nondestructive attachment and detachment of the first section to the central section, with the first surface of the first section in overlapping engagement with the first surface of the central section, (d) a second section pivotably connected to the central section and having a first surface defining a cavity, (e) a means for repeatedly permitting nondestructive attachment and detachment of the second section to the first section, with the first surface of the second section in overlapping engagement with the second surface of the first section, and (f) a tape strip pad attached to the first surface of the central section within the open well, (g) wherein the sections are configured and arranged relative to one another such that (i) the first surface of the central section and the first surface of the first section cooperatively form a retention chamber when the first surface of the first section is pivoted into overlapping engagement with the first surface of the central section, and (ii) the second section covers the opening in the first section when (A) the first surface of the first section is pivoted into overlapping engagement with the first surface of the central section, and (B) the first surface of the second section is pivoted into overlapping engagement with the second surface of the first section.

8. The dispenser blank of claim 7, wherein the tape strip pad is adhesively attached to the first surface of the central section within the open well.

9. The dispenser blank of claim 7, wherein the dispenser blank is constructed from a single sheet of thermoplastic sheet material.

10. The dispenser blank of claim 7, wherein (i) the central section has a first longitudinal end, a second longitudinal end, a first lateral side and a second lateral side, (ii) the first section is pivotably attached to the first lateral side of the central section, and (iii) the second section is pivotably attached to the second lateral side of the central section.

11. A single-piece dispenser blank of integrally formed construction having opposed first and second surfaces, comprising:

(a) a central section having (I) a longitudinal length of between about 7 to 10 cm, (ii) a lateral width of about 3 to 5 cm, and (iii) a circumferential wall projecting from the first surface and defining an open well with a depth of about 0.2 to 2 cm, (b) a first section pivotably connected to the central section and having (i) a longitudinal length of between about 7 to 10 cm, (ii) a lateral width of about 3 to 5 cm, (iii) a first surface defining a cavity with a depth of about 0.5 to 2 cm, (iv) a second surface, and (v) an access opening with a longitudinal length of about 2 to 5 cm and a lateral width of about 1 to 3 cm, (c) a means for repeatedly permitting nondestructive attachment and detachment of the first section to the central section, with the first surface of the first section in overlapping engagement with the first surface of the central section, (d) a second section pivotably connected to the central section and having (i) a longitudinal length of between about 7 to 10 cm, (ii) a lateral width of about 3 to 5 cm, and (iii) a first surface defining a cavity with a depth of about 0.5 to 2 cm, and (e) a means for repeatedly permitting nondestructive attachment and detachment of the second section to the first section, with the first surface of the second section in overlapping engagement with the second surface of the first section, (f) wherein the sections are configured and arranged relative to one another such that (i) the first surface of the central section and the first surface of the first section cooperatively form a retention chamber having a longitudinal length of between about 5 to 10 cm, a lateral width of about 2 to 5 cm, and a depth of about 1 to 2 cm when the first surface of the first section is pivoted into overlapping engagement with the first surface of the central section, and (ii) the second section covers the opening in the first section when (A) the first surface of the first section is pivoted into overlapping engagement with the first surface of the central section, and (B) the first surface of the second section is pivoted into overlapping engagement with the second surface of the first section.

12. The dispenser blank of claim 11, wherein the dispenser blank is constructed from a single sheet of thermoplastic sheet material.

13. The dispenser blank of claim 11, wherein (i) the central section has a first longitudinal end, a second longitudinal end, a first lateral side and a second lateral side, (ii) the first section is pivotably attached to the first lateral side of the central section, and (iii) the second section is pivotably attached to the second lateral side of the central section.

* * * * *

UNITED STATES PATENT AND TRADEMARK OFFICE

CERTIFICATE OF CORRECTION

PATENT NO. : 6,102,247
DATED : August 15, 2000
INVENTOR(S) : Dennis L. Crawford

It is certified that error appears in the above-identified patent and that said Letters Patent is hereby corrected as shown below:

Column 1,
Line 67, insert -- Des. -- before "348,690".
Line 67, insert -- Des. -- before "348,484".
Line 67, insert -- Des. -- before "359,513".
Line 67, insert -- Des. -- before "387,806".

Signed and Sealed this

Twentieth Day of November, 2001

*Attest:*

Nicholas P. Godici

*Attesting Officer*

NICHOLAS P. GODICI
*Acting Director of the United States Patent and Trademark Office*